US012134940B2

(12) United States Patent
Morgan

(10) Patent No.: US 12,134,940 B2
(45) Date of Patent: Nov. 5, 2024

(54) WEAR RESISTANT TUBULAR MEMBERS AND SYSTEMS AND METHODS FOR PRODUCING THE SAME

(71) Applicant: National Oilwell Varco, L.P., Houston, TX (US)

(72) Inventor: Dan William Morgan, Navasota, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/310,690

(22) Filed: May 2, 2023

(65) Prior Publication Data

US 2023/0383612 A1 Nov. 30, 2023

Related U.S. Application Data

(60) Provisional application No. 63/346,032, filed on May 26, 2022.

(51) Int. Cl.

| | |
|---|---|
| ***E21B 17/10*** | (2006.01) |
| ***E21B 17/042*** | (2006.01) |
| ***E21B 17/22*** | (2006.01) |

(52) U.S. Cl.
CPC ..... *E21B 17/1085* (2013.01); *E21B 17/042* (2013.01); *E21B 17/22* (2013.01)

(58) Field of Classification Search
CPC ... E21B 17/1085; E21B 17/22; E21B 17/1078
See application file for complete search history.

(56) References Cited

U.S. PATENT DOCUMENTS

| | | | | |
|---|---|---|---|---|
| 3,285,678 | A * | 11/1966 | Garrett | E21B 17/1078 175/325.2 |
| 3,773,359 | A * | 11/1973 | Chance | E21B 17/16 175/325.1 |
| 8,783,344 | B2 | 7/2014 | Aung et al. | |
| 2003/0136587 | A1* | 7/2003 | Boulet | E21B 17/10 175/323 |
| 2009/0258250 | A1* | 10/2009 | Daemen | F16L 58/182 228/101 |

(Continued)

OTHER PUBLICATIONS

PCT/US2023/066478 International Search Report and Written Opinion dated Jul. 24, 2023 (15 p.).

*Primary Examiner* — David Carroll
(74) *Attorney, Agent, or Firm* — CONLEY ROSE, P.C.

(57) ABSTRACT

A tubular member includes a central axis, a first end, a second end opposite the first end, and a throughbore extending axially from the first end to the second end. In addition, the tubular member includes a first connector at the first end and a second connector at the second end. Further, the tubular member includes a tubular region axially positioned between and axially spaced from the first connector and the second connector. The tubular member also includes a first upset axially positioned between the tubular region and the first connector. The first upset has an internal transition within the throughbore that increases an inner diameter of the throughbore when moving axially from the first upset to the tubular region. Moreover, the tubular member includes a first wear pad integrally formed on the tubular region. An outer diameter of the tubular member is greater along the first wear pad than along the tubular region.

21 Claims, 8 Drawing Sheets

(56) References Cited

U.S. PATENT DOCUMENTS

| | | | |
|---|---|---|---|
| 2012/0199400 | A1 | 8/2012 | Boulet et al. |
| 2013/0313025 | A1 | 11/2013 | Aung et al. |
| 2019/0338603 | A1 | 11/2019 | Conrad et al. |

* cited by examiner

WEAR RESISTANT TUBULAR MEMBERS AND SYSTEMS AND METHODS FOR PRODUCING THE SAME

CROSS-REFERENCE TO RELATED APPLICATIONS

This application claims benefit of U.S. provisional patent application Ser. No. 63/346,032 filed May 26, 2022, and entitled "Wear Resistant Tubular Members and Systems and Methods for Producing the Same," which is hereby incorporated herein by reference in its entirety for all purposes.

STATEMENT REGARDING FEDERALLY SPONSORED RESEARCH OR DEVELOPMENT

Not applicable.

BACKGROUND

Elongate tubulars are used in many industrial applications, such as, for example, oil and gas drilling and production. In particular, in oil and gas drilling operations, a drill bit is threadably attached at one end of a tubular and then is rotated (e.g., from the surface, downhole by a mud motor, etc.) in order to form a borehole within a subterranean formation. As the bit advances within the subterranean formation, additional tubulars are attached (e.g., threadably attached) at the surface, thereby forming a drill string which extends the length of the borehole.

BRIEF SUMMARY

Some embodiments disclosed herein are directed to tubular members. In one embodiment, a tubular member comprises a central axis, a first end, a second end opposite the first end, and a throughbore extending axially from the first end to the second end. In addition, the tubular member comprises a first connector at the first end and a second connector at the second end. Further, the tubular member comprises a tubular region axially positioned between and axially spaced from the first connector and the second connector. The tubular member also comprises a first upset axially positioned between the tubular region and the first connector. The first upset has an internal transition within the throughbore that increases an inner diameter of the throughbore when moving axially from the first upset to the tubular region. Moreover, the tubular member comprises a first wear pad integrally formed on the tubular region. An outer diameter of the tubular member is greater along the first wear pad than along the tubular region.

Some embodiments disclosed herein are directed to methods of manufacturing tubular members. In one embodiment, a method of manufacturing a tubular member comprises (a) removing material from a radially outer surface of a cylindrical tubular member, wherein the cylindrical tubular member has a central axis. In addition, the method comprises (b) forming a wear pad on the radially outer surface of the tubular member as a result of (a). Further, the method comprises (c) upsetting an axial end of the tubular member to form an internal transition that increases an inner diameter of the cylindrical tubular member when moving axially from the axial end. The method also comprises (d) attaching a connector to the upset axial end.

Some embodiments disclosed herein are directed to drill pipes. In one embodiment, a drill pipe comprises a central axis, a box connector, and a pin connector axially spaced from the threaded box connector. In addition, the drill pipe comprises a tubular region axially positioned between and axially spaced from the box connector and the pin connector. Further, the drill pipe comprises a first upset positioned between the tubular region and the box connector. Still further, the drill pipe comprises a second upset positioned between the tubular region and the pin connector. The drill pipe also comprises a throughbore extending axially through the box connector, the first upset, the tubular region, the second upset, and the pin connector. An inner diameter of the throughbore increases moving axially from the first upset into the tubular region and moving axially from the second upset into the tubular region. Moreover, the drill pipe comprises a wear pad formed on the tubular region. An outer diameter of the drill pipe is greater along the wear pad than along the tubular region.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

During a borehole drilling operation, a drill bit is mounted on the lower end of a drill string and is rotated by rotating the drill string at the surface, by actuation of downhole motors or turbines, or both. With weight applied to the drill string, the rotating drill bit engages a subterranean formation and proceeds to form a borehole along a predetermined path toward a target zone. During these drilling operations, the drill string (or portions thereof) may engage the sidewall of the borehole or other downhole object thereby resulting in wear along the outer surface of the drill string (or more particularly the drill pipes that make up the drill string). Such engagement may be particularly pronounced in horizontal drilling operations where the path of the borehole departs from vertical. Ultimately, the wear along the outer surface of the drill pipes making up drill string may reduce the strength and service life of these components.

Accordingly, embodiments disclosed herein include tubular members and methods for producing tubular members, which may have a greater service life and durability than standard tubular members. In particular, the disclosed embodiments may include tubular members for drill strings which have one or more wear pads that are to increase fatigue resistance, wear resistance and damage tolerance of the tubular members during drilling operations.

Figure 1:
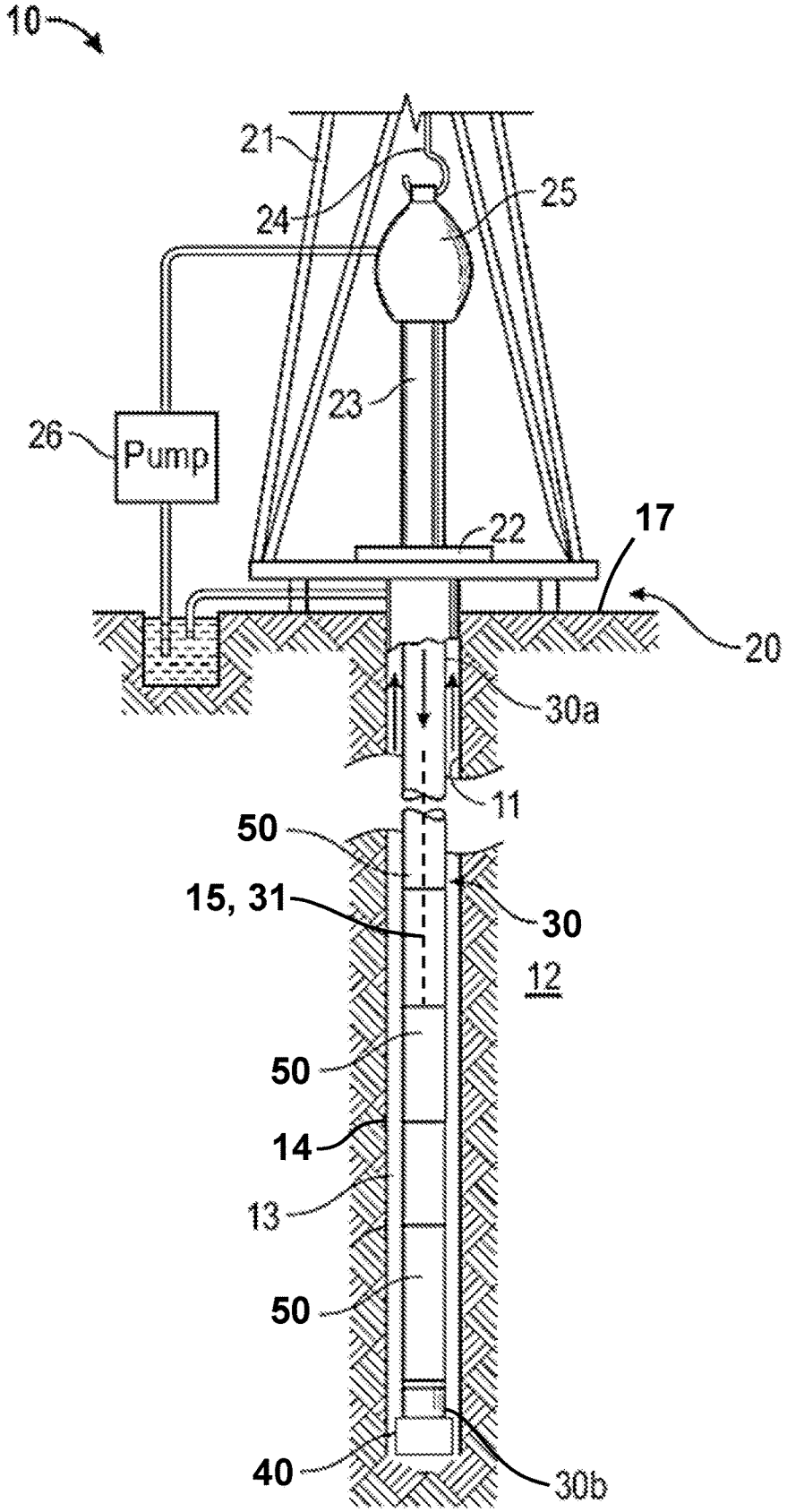
FIG. 1 is a schematic view of a drilling system according to some embodiments.

Referring now to FIG. 1, an embodiment of a drilling system 10 is schematically shown. In this embodiment, drilling system 10 includes a drilling rig 20 positioned over a borehole 11 penetrating a subsurface formation 12, a casing 14 extending from the surface 17 into the upper portion of borehole 11 along a central or longitudinal axis 15, and a drill string 30 suspended in borehole 11 from a derrick 21 of rig 20. Drill string 30 has a central or longitudinal axis 31 that, in this embodiment, is aligned with axis 15 of casing 14 (note: such alignment is not required and may vary), a first or uphole end 30*a* coupled to derrick 21, and a second or downhole end 30*b* opposite end 30*a*. In addition, drill string 30 includes a drill bit 40 at downhole end 30*b*, and a plurality of drill pipe joints 50 (or more simply drill pipes 50) extending from bit 40 to uphole end 30*a*. Drill pipes 50 are connected end-to-end, and bit 40 is connected to a lower end of the lowermost pipe 50. A bottomhole assembly (BHA) (not shown) can be disposed in drill string 30 proximal the bit 40 (e.g., axially between bit 40 and the lowermost pipe 50).

In this embodiment, drill bit 40 is rotated via rotation of drill string 30 from the surface. In particular, drill string 30 is rotated by a rotary table 22 that engages a kelly 23 coupled to uphole end 30*a* of drill string 30. Kelly 23, and hence drill string 30, is suspended from a hook 24 attached to a traveling block (not shown) with a rotary swivel 25 which permits rotation of drill string 30 relative to derrick 21. Although drill bit 40 is rotated from the surface with drill string 30 in this embodiment, in general, the drill bit (e.g., drill bit 40) can be rotated with a rotary table or a top drive, rotated by a downhole mud motor disposed in the BHA, or combinations thereof (e.g., rotated by both rotary table via the drillstring and the mud motor, rotated by a top drive and the mud motor, etc.). For example, rotation via a downhole motor may be employed to supplement the rotational power of a rotary table 22, if required, and/or to effect changes in the drilling process. Thus, it should be appreciated that the various aspects disclosed herein are adapted for employment in each of these drilling configurations.

During drilling operations, a mud pump 26 at the surface 17 pumps drilling fluid or mud down the interior of drill string 30 via a port in swivel 25. The drilling fluid exits drill string 30 through ports or nozzles in the face of drill bit 40, and then circulates back to the surface 17 through the annulus 13 between drill string 30 and the sidewall of borehole 11. The drilling fluid functions to lubricate and cool drill bit 40, carry formation cuttings to the surface 17, and maintain the pressure necessary to prevent blowouts.

Figure 2:
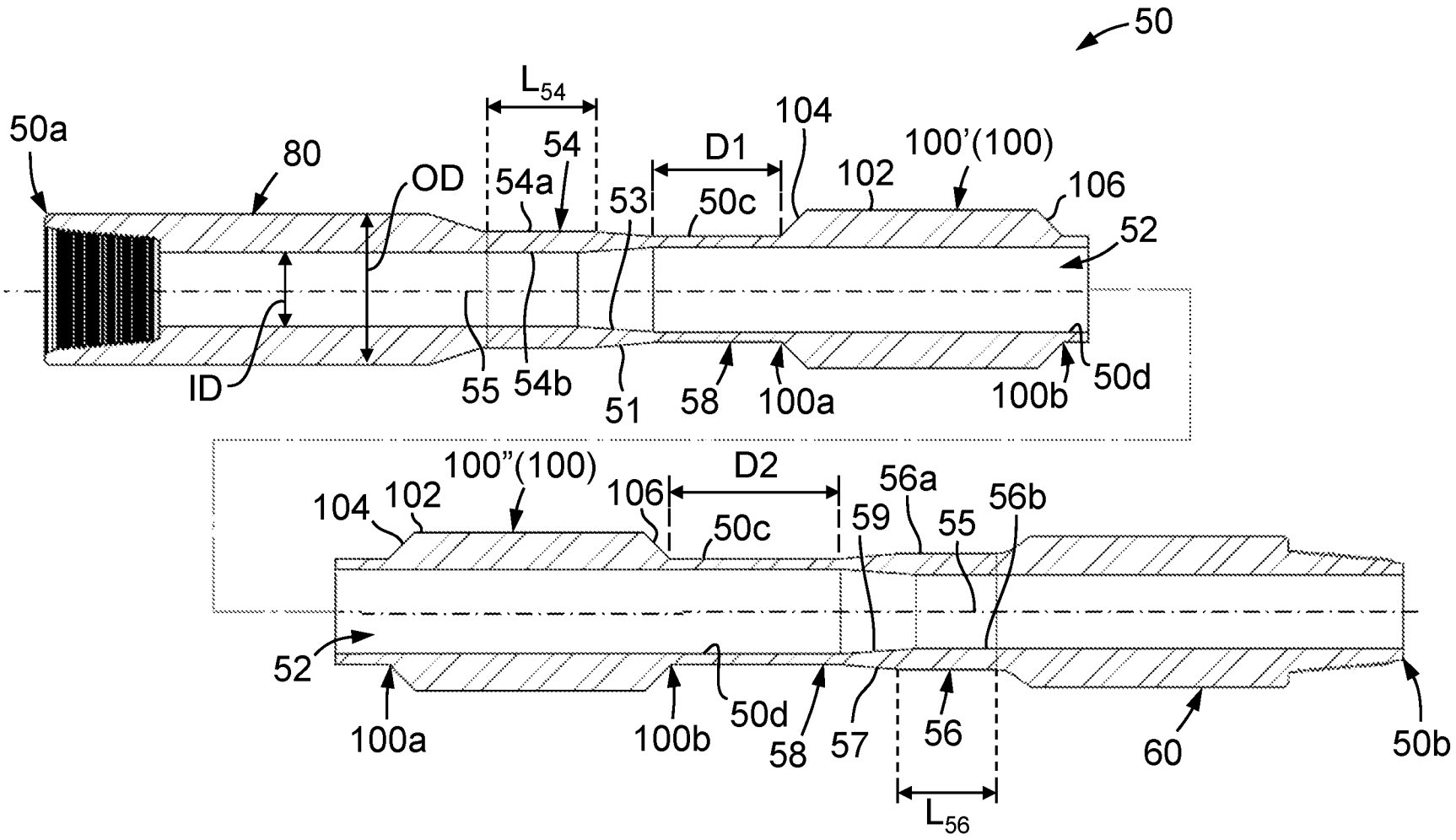
FIG. 2 is a side cross-sectional view of a drill pipe of the drilling system of FIG. 1 including one or more wear pads according to some embodiments.

Referring now to FIG. 2, each drill pipe 50 making up drill string 30 is an elongate tubular member that is configured to be threadably connected to each adjacent drill pipe or other component (e.g., drill bit 40, BHA, etc.). Each drill pipe 50 includes a central or longitudinal axis 55 that is aligned with axis 31 of drill string 30 during operations, a first or upper end 50*a*, a second or lower end 50*b* opposite upper end 50*a*, a radially outer surface 50*c* extending axially between ends 50*a*, 50*b*, and a radially inner surface 50*d* defining a throughbore 52 that also extends axially between ends 50*a*, 50*b*.

A threaded connector is disposed at each end 50*a*, 50*b* to facilitate the threaded connection of joint 50 within drill string 30 as previously described. In particular, a female or box threaded connector 80 (or more simply "box 80") is positioned at upper end 50*a* and a male or pin threaded connector 60 (or more simply "pin 60") is positioned at lower end 50*b*. Box 80 includes a plurality of internal threads that are configured to threadably mate and connect with the threads of a pin connector (e.g., pin 60) of an axially adjacent drill pipe 50 (e.g., with respect to axis 31) and pin 60 includes a plurality of external threads that are configured to threadably mate and connect with the threads of a box threaded connector (e.g., box 80) of an axially adjacent drill pipe 50 (e.g., with respect to axis 31).

Figure 3:
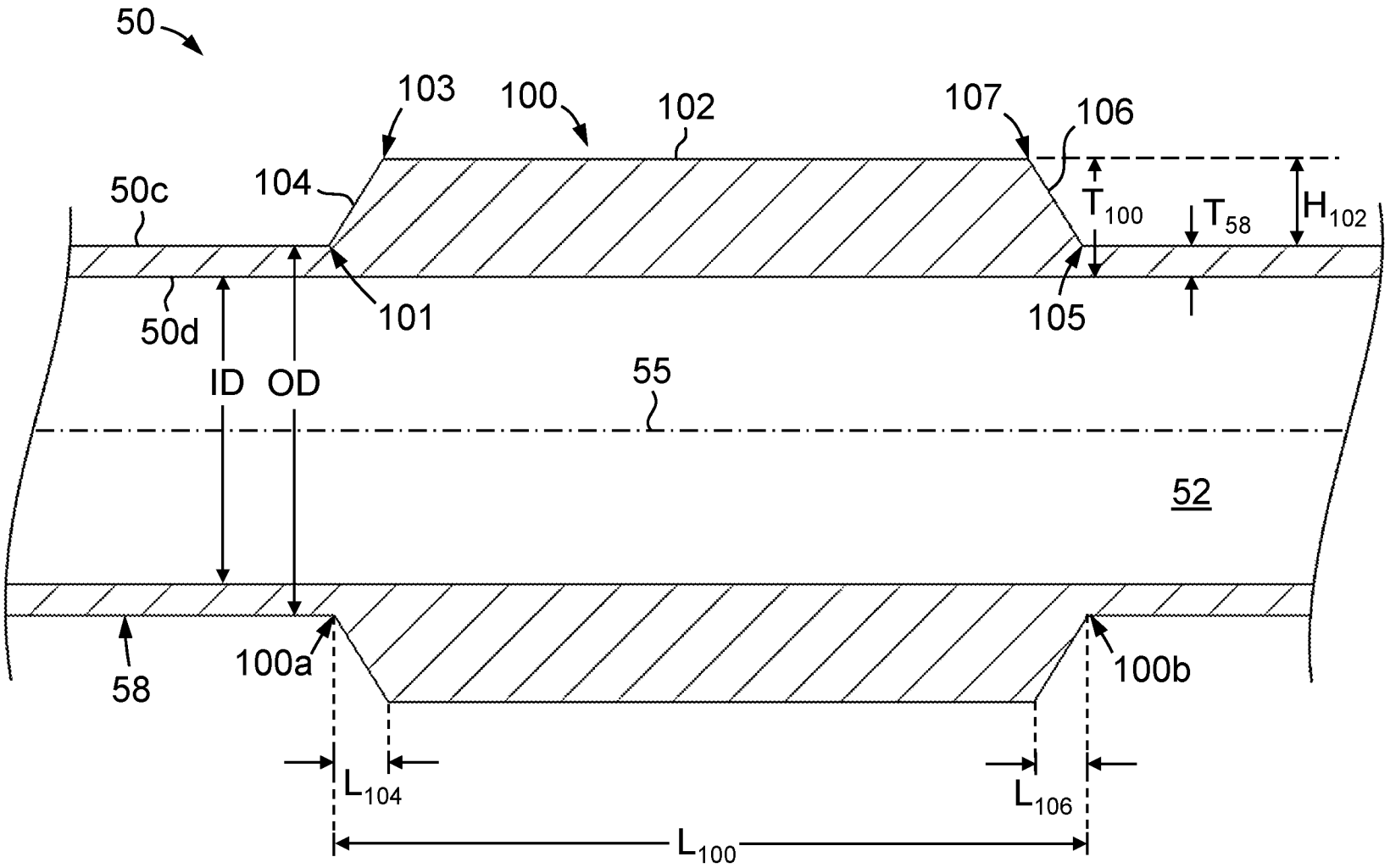
FIG. 3 is an enlarged partial side cross-sectional view of one of the wear pads of the drill pip of FIG. 2 according to some embodiments.

Referring still to FIGS. 2 and 3, drill pipe 50 also includes a pair of upsets each extending axially from one of the threaded connectors 60, 80 to a central tubular region 58 (or more simply "tubular region 58"). As used herein, the term "upset" generally refers to an increase in the cross-sectional area of drill pipe 50 relative to the cross-section area within tubular region 58. In particular, drill pipe 50 includes a first or upper upset 54 extending axially between box 80 and tubular region 58 and a second or lower upset 56 extending axially between pin 60 and tubular region 58. Each upset 54, 56 includes an expanded cross-sectional area such that radially outer surface 50*c* is expanded radially outward from axis 55 at upsets 54, 56 relative to region 58 to form an external upset 54*a*, 56*a*, and radially inner surface 50*d* is expanded radially inward toward axis 55 at upsets 54, 56 relative to tubular region 58 to form an internal upset 54*b*, 56*b*.

The external upset 54*a* includes a transition 51 that smoothly decreases the outer diameter OD of drill pipe 50 between the external upset 54*a* and the tubular region 58. The internal upset 54*b* also includes a transition 53 that smoothly increases the inner diameter ID of drill pipe 50 between the internal upset 54*b* and the tubular region 58. Likewise, the external upset 56*a* includes a transition 57 that smoothly decreases the outer diameter OD of drill pipe 50 between the external upset 56*a* and the tubular region 58. The internal upset 56*b* also includes a transition 59 that smoothly increases the inner diameter ID of drill pipe 50 between the internal upset 56*b* and the tubular region 58. The transitions 51, 53, 57, 59 are frustoconical surfaces that extend between the cylindrical surfaces forming the radially outer surface 50*c* and the radially inner surface 50*d* within the upsets 54, 56 and tubular region 58 as previously described and shown in FIG. 2. The internal transitions 53, 59 may be more commonly referred to as $M_{iu}$, wherein the subscript "iu" refers to "internal upset."

As is described in more detail below, drill pipe 50 is assembled by forming upsets 54, 56 at the axial ends of region 58. Thereafter, threaded connectors 60, 80 are secured to upsets 56, 54, respectively, by any suitable method (e.g., welding, integral formation, threads, heat shrink, etc.). In addition, upsets 54, 56 may be formed on tubular region 58 by any suitable method while still complying with the principles disclosed herein. For example, in some embodiments, upsets 54, 56 are formed by heating the axial ends of tubular region 58, and impacting each heated end along axis 55, thereby forcing surface 50*d* to radially expand in the manner described above (and shown).

Each upset 54, 56 may have an axial length extending from the threaded connector 60, respectively, to the transition 51, 57, respectively along the radially outer surface 50*c*. In particular, the upper upset 54 has an axial length $L_{54}$ extending along external upset 54*a* from the threaded connector 80 to external transition 51, and the lower upset 56 has an axial length $L_{56}$ extending along external upset 56*a* from the threaded connector 60 to the external transition 57. In some embodiments, the axial lengths $L_{54}$, $L_{56}$ of upsets 54, 56 may be increased to increase fatigue resistance for the tubular member 50. For instance, in some embodiments, the axial lengths $L_{54}$, $L_{56}$ may be greater than 4 inches (in), such as, for instance 6 in or 8 in.

In some embodiments, the axial length of the threaded connectors 60, 80 may be increased in addition to or in lieu of an increase in the axial lengths $L_{54}$, $L_{56}$. For instance, a weld neck of each connector 60, 80 (that is a portion of the connector 60, 80 that is welded or otherwise connected to the upsets 54, 56 as previously described above) may be lengthened to achieve a similar increase in fatigue resistances for the tubular member as previously described.

The drill pipe 50 also includes one or more wear pads 100 that are positioned along the tubular region 58. The wear pads 100 are characterized by a general increase in thickness in the wall of the drill pipe 50 (e.g., radially between the radially inner surface 50*d* and the radially outer surface 50*c*) along and relative to the tubular region 58.

Referring briefly to FIGS. 1 and 2, during operations as drill string 30 and drill bit 40 rotate within borehole 11, the wear pads 100 on drill pipes 50 engage with the inner wall of the borehole (e.g., borehole 11) or other downhole object. However, damage to the drill pipes 50 as a result of this engagement may be limited or prevented entirely due to the increased wall thickness associated with the wear pads 100.

In some embodiments, the drill pipe 50 may include one or more (e.g., such as a plurality) of wear pads 100 that are positioned along the tubular region 58 such that the above-noted contact between the inner wall of borehole 11 (or other downhole object) and the drill pipe 50 occurs on the wear pads 100. In the embodiment of FIG. 2, there are two wear pads that are axially spaced from one another along the central axis 55 within the central tubular region 58. Regardless of the number of wear pads 100, each wear pad 100 may be axially spaced from both the external transitions 51, 57 and internal transitions 53, 59, and positioned within the tubular region 58.

The one or more wear pads 100 may be integrally formed with the tubular region 58. Thus, the wear pad(s) 100 and the tubular region 58 may be formed as a single-piece monolithic body or structure. As is described in more detail below, the wear pad(s) 100 may be machined or formed on the tubular member 58 by removing material from a radially outer surface of a cylindrical tubular member (e.g., a blank pipe).

It should also be appreciated that, within drill string 30, the drill pipes 50 that include the wear pads 100 (e.g., such as the drill pipe 50 shown in FIG. 2) may comprise standard weight drill pipe as opposed to so-called heavy weight drill pipe which is typically associated with thicker pipe walls that are intended to increase a weight applied to the drill bit 40 during operations and to provide a transition from drill collars to drill pipe. Heavy weight drill pipe is typically located in the lower portions of the drill string 30 (e.g., close to the drill bit and/or at or near an elbow or curve in the wellbore) as the additional weight associated with such heavier drill pipe may cause buckling or other failures if distributed too high along the drill string 30. Thus, by including the wear pads 100 on the standard weight drill pipes 50, the upper portions or sections of the drill string 30 may be more protected from wear or damage during drilling operations in the manner described above. Further details of embodiments of the drill pipe 50 and wear pads 100 are provided below.

Referring now to FIG. 3, each wear pad 100 includes a first or uphole end 100*a*, and a second or downhole end 100*b* opposite uphole end 100*a*. In addition, each wear pad 100 includes a radially outer cylindrical surface 102 spaced between the ends 100*a*, 100*b*, and a pair of transitional surfaces 104, 106 extending from the cylindrical surface 102 to the ends 100*a*, 100*b*, respectively. The outer diameter OD of the drill pipe 50 may reach a maximum value for the wear pad 100 along the cylindrical surface 102, such that the transitional surfaces 104, 106 may smoothly increase the outer diameter OD of drill pipe from the tubular region 58 to the cylindrical surface 102. Thus, the transitional surfaces 104, 106 may be frustoconical in shape. The inner diameter ID of the drill pipe 50 may remain constant (or substantially constant within a suitable tolerance) within the tubular region 58, including along the wear pads 100.

Referring now to FIGS. 2 and 3, each wear pad 100 may have a wall thickness $T_{100}$ along the cylindrical surface 102 that is greater than a wall thickness $T_{58}$ of the tubular region 58. The wall thickness $T_{100}$ may be measured radially between the radially outer surface 50*c* and the radially inner surface 50*d* relative to axis 55 along the cylindrical surface 102, and the wall thickness $T_{58}$ may be measured radially between the radially outer surface 50*c* and the radially inner surface 50*d* relative to axis 55 along the tubular region 58. In some embodiments, the wall thickness $T_{100}$ of the wear pads 100 may be about 3% to about 81% greater than the wall thickness $T_{58}$ within tubular region 58. As a result, a ratio of the wall thickness $T_{100}$ to the wall thickness $T_{58}$ ($T_{100}/T_{58}$) may range from about 1.3 to about 2 in some embodiments. As a result of the differences between the wall thickness $T_{100}$ and $T_{58}$, the cylindrical surface 102 may extend to a radial height $H_{102}$ above the radially outer surface 50*c* within tubular region 58 that may range from about 1/16 in (0.0625 in) to about 1/4 in (0.25 in) in some embodiments, such as for instance, 1/16 in, 1/8 in, 3/16 in, 1/4 in, etc.

As shown in FIG. 3, each wear pad 100 includes a radius 101 between the upper transitional surface 104 and the tubular region 58 and a radius 103 between the transitional surface 104 and the cylindrical surface 102. In addition, each wear pad 100 includes a radius 107 between the transitional surface 106 and the cylindrical surface 102, and a radius 105 between the transitional surface 106 and the tubular region 58. The radiuses 101, 105 may be concave radiuses, and the radiuses 103, 107 may be convex radiuses. Further, each wear pad 100 may include a total axial length $L_{100}$ extending axially between radiuses 101, 105 and ends 100*a*, 100*b* along axis 55. Upper transitional surface 104 may have an axial length $L_{104}$ extending between radiuses 101, 103 and lower transitional surface 106 may have an axial length $L_{106}$ extending between radiuses 105, 107. The axial lengths $L_{104}$, $L_{106}$ may be generally increased within the tubular member to reduce bending stresses in the tubular region 58 due to the wear pads 100. For instance, in some embodiments the axial lengths $L_{104}$, $L_{106}$ may be greater than 1 inch, such as, for instance from about 1.5 in to about 3 in. However, in some embodiments, the one or more of the axial lengths $L_{104}$, $L_{106}$ may be greater than 3 in.

In some embodiments, the axial lengths $L_{104}$, $L_{106}$ may range from about 6.25% to about 12.5% of the total axial length $L_{100}$ of the corresponding wear pad 100. However, in some embodiments, the axial lengths $L_{104}$, $L_{106}$ may be below 6.25% or above 12.5% of the total axial length $L_{100}$ of the corresponding wear pad 100. The axial lengths $L_{104}$, $L_{106}$ may be the same or different. In some embodiments, at least one of the lengths $L_{104}$, $L_{106}$ may be set such that a rate of tapering or wall thickness change along at least one of the transitional surfaces 104, 106 may substantially match the rate of tapering or wall thickness change along the internal transitions 53, 59, respectively. Further, as the lengths $L_{104}$, $L_{106}$ increase or decrease, the radiuses 101, 103, 105, 107 may also increase or decrease, respectively.

As previously described, in the embodiment depicted in FIG. 2, there is a total of two wear pads 100 axially spaced from one another within the tubular region 58. Specifically, in the embodiment of FIG. 2, there is a first or uphole wear pad 100' and a second or downhole wear pad 100". The uphole wear pad 100' is axially spaced between the uphole end 50*a* of drill pipe 50 and the downhole wear pad 100", and the downhole wear pad 100" is axially spaced between the uphole wear pad 100' and the downhole end 50*b* of drill pipe 50. The uphole end 100*a* of the uphole wear pad 100' may be axially spaced from the internal transition 53 (or more specifically, the downhole end of the internal transition 53) at a distance D1. In addition, the downhole end 100*b* of the downhole wear pad 100" may be axially spaced from the internal transition 59 (or more specifically the uphole end of the internal transition 59) at a distance D2. The distance D1 and the distance D2 may range from 7.5 feet (ft) to 15 ft in some embodiments. In addition, in some embodiments, a single wear pad 100 may be positioned along the tubular region 58, and the uphole end 100*a* of the wear pad 100 may be spaced at the distance D1 from the internal transition 53 (or more specifically the downhole end of the internal transition 53) and the downhole end 100*b* of wear pad 100 may be spaced at the distance D2 from the internal transition 59 (or more specifically the uphole end of the internal transition 59).

Referring now to FIGS. 2 and 3, in some embodiments, the wear pads 100', 100" may have the same axial length (e.g., axial length $L_{100}$ shown in FIG. 3) or different axial lengths. In some embodiments, the wear pads 100', 100" may have the same outer maximum diameter OD (e.g., along cylindrical surface 102 as shown in FIG. 3), or may have different maximum outer diameters OD. For instance, in some embodiments, wear pads 100 on tubular member 50 that are located at or proximately closer to an axial middle of the tubular region 58 may have a greater outer diameter OD along the cylindrical surface 102 than wear pads 100 on tubular member that are located at or proximately closer to the threaded connectors 80, 60.

Figure 4:
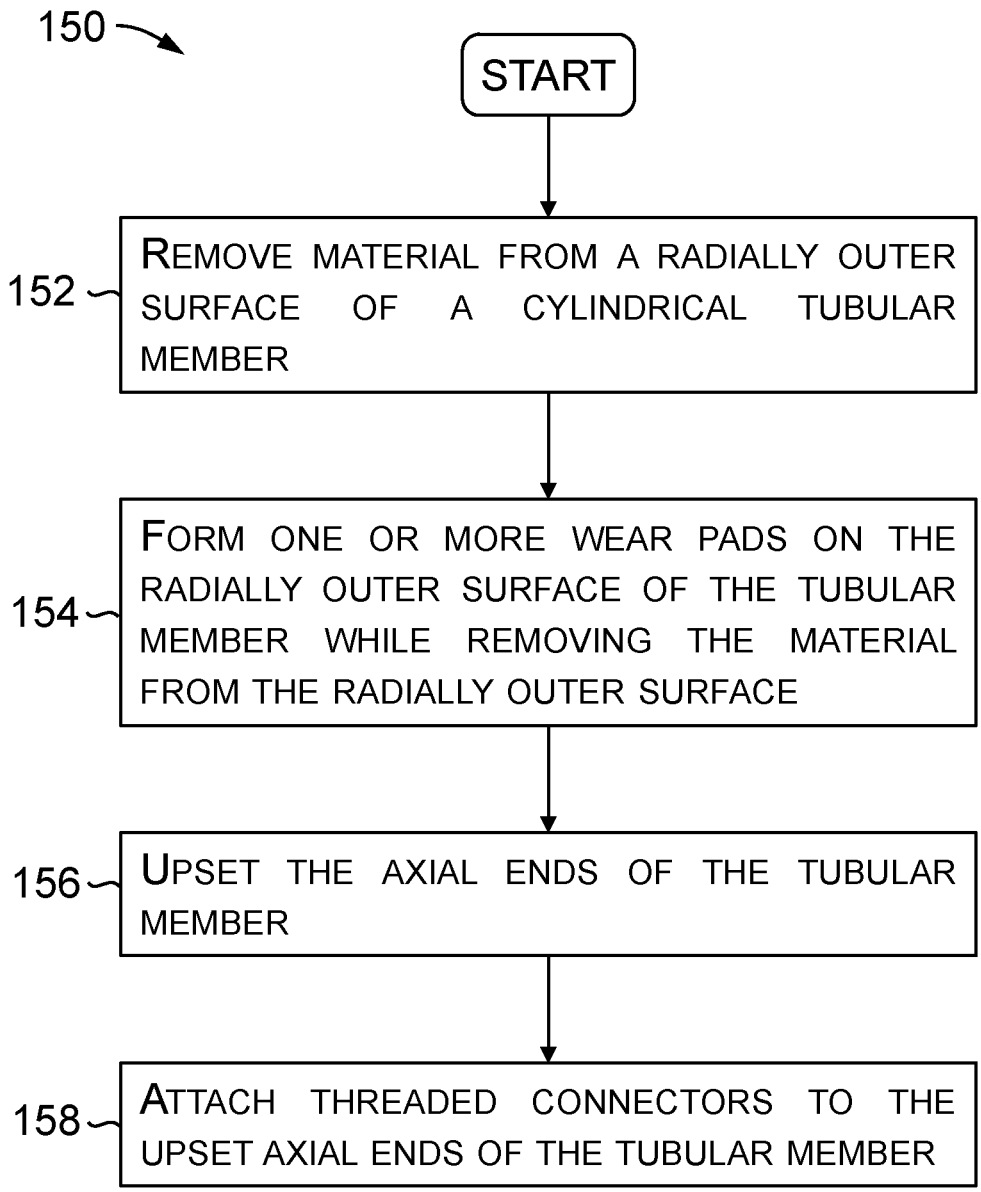
FIG. 4 is a block diagram of a method of a method of manufacturing a tubular member according to some embodiments.

Referring now to FIG. 4, a method 150 of manufacturing a tubular member, such as a drill pipe, having one or more wear pads (e.g., wear pad 100) as described herein. The method 150 may be utilized to produce the drill pipe 50 of FIGS. 2 and 3. Thus, in describing the features of method 150, reference is also made to FIGS. 5-8 which illustrate the features of method 150 according to some embodiments.

Figure 5:
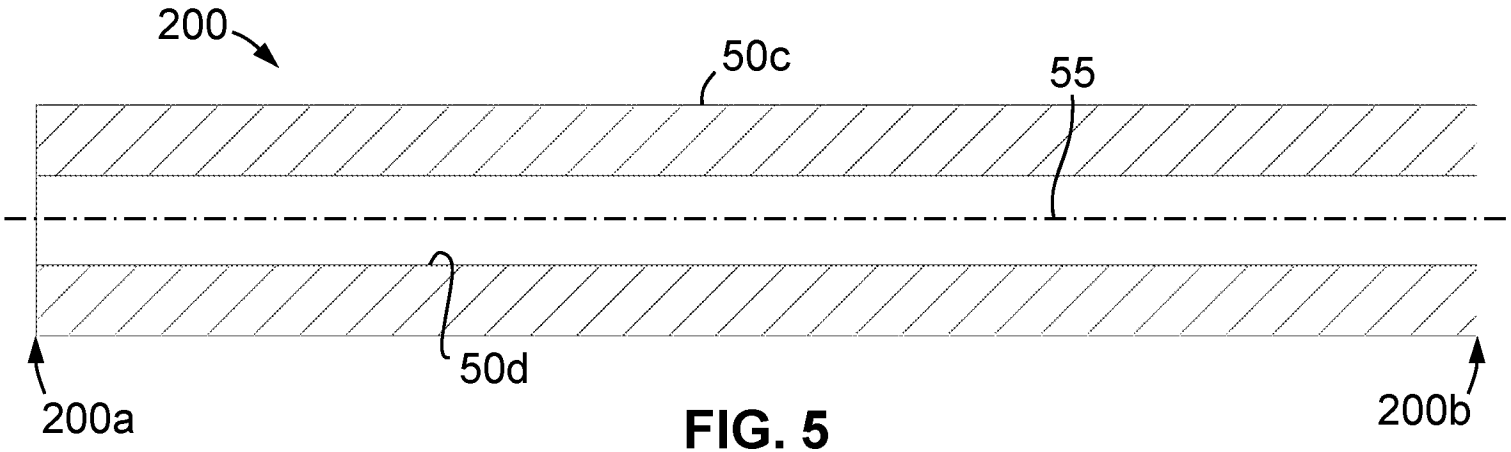
FIGS. 5-8 are sequential cross-sectional view of a process of forming the tubular member of FIG. 2 via the method of FIG. 4 according to some embodiments.

Initially, method 150 includes removing material from a radially outer surface of a cylindrical tubular member at block 152 and forming one or more wear pads on the radially outer surface of the tubular member while removing the material from the radially outer surface at block 154. For instance, FIG. 5 shows a blank cylindrical tubular member 200 (or more simply "tubular member 200") having a first or upper end 200*a*, and a second or lower end 200*b* opposite the upper end 200*a*. As previously described, utilizing the method 150, the tubular member 200 may be manufactured or transformed into the drill pipe 50 shown in FIG. 2. Thus, the tubular member 200 includes the central axis 55, the radially inner surface 50*d*, and the radially outer surface 50*c* as previously described above.

Figure 6:
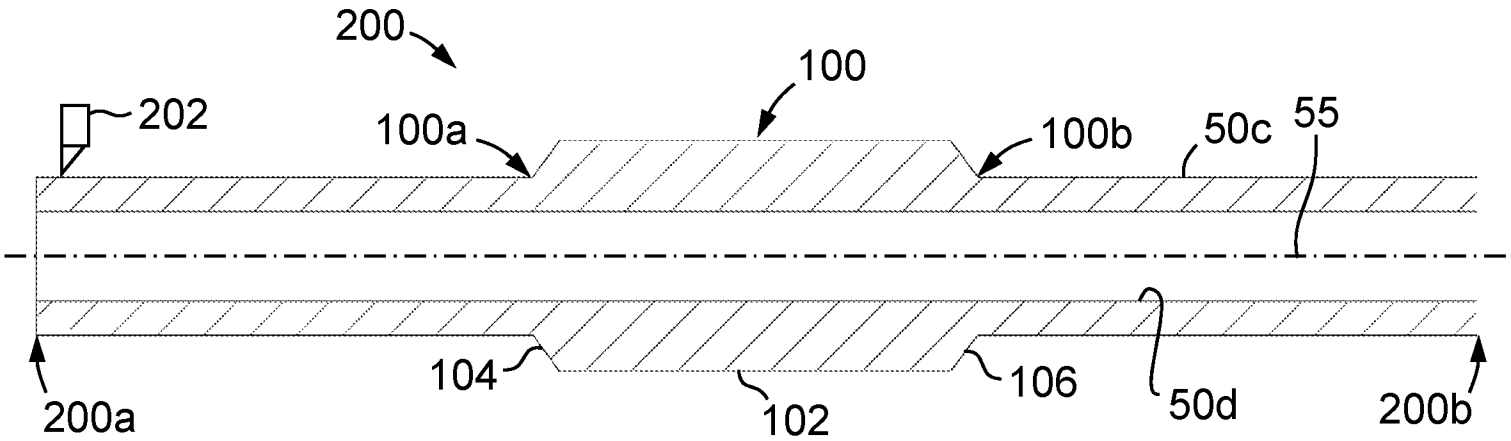
Figure 7:
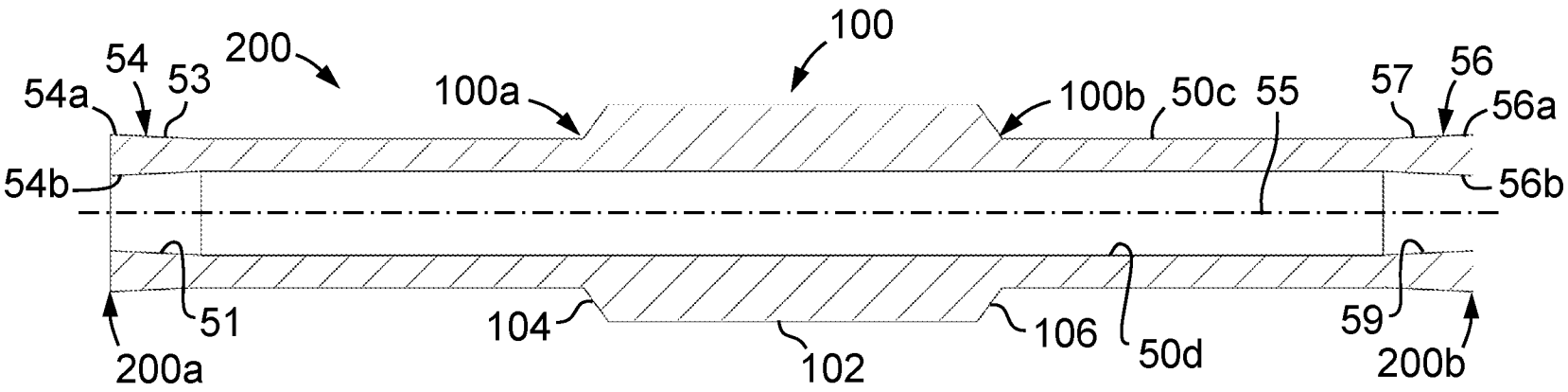
Figure 8:
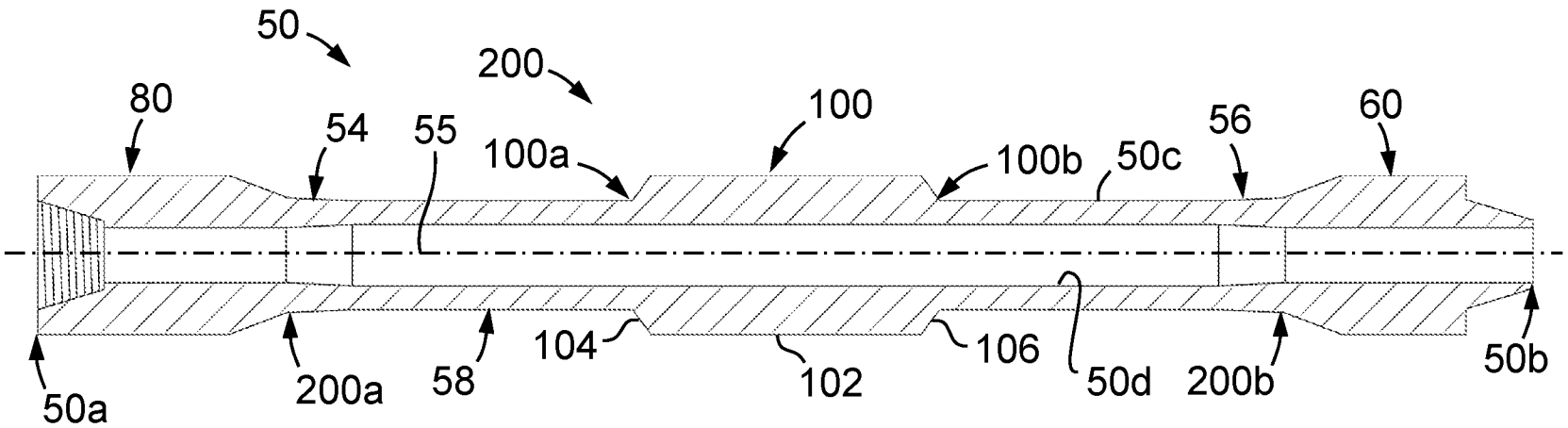

FIG. 6 shows a tool 202 that is utilized to remove material from the radially outer surface 50*c* per block 152 in method 150. The tool 202 may comprise any suitable tool, implement, or collection thereof that may be used to remove metallic or other suitable materials. For instance, in some embodiments, the tool 202 may comprise a cutting tool, bit, grinder, sander, etc. that is mounted within a lathe, computer numerical control (CNC) machine, mill, etc. During operations, the tool 202 may engage with the radially outer surface 50*c* (during which the tubular member 200 may be rotating about the central axis such that layers or ribbons of material are removed (or machined) away from the radially outer surface 50*d*. The engagement of the tool 202 with the radially outer surface 50*c* may be controlled such that as material is removed from the radially outer surface 50*c*, one or more wear pads 100 are formed on the tubular member 200 per block 154. Specifically, less material may be removed from the radially outer surface 50*c* in selected location(s) such that one or more wear pads 100 are integrally formed along the radially outer surface 50*c*. The wear pads 100 may be the same as that previously described above, and thus, the wear pad(s) 100 may include the ends 100*a*, 100*b*, and surfaces 102, 104, 106 as previously described.

Referring again to FIG. 4, the method 150 also includes upsetting the axial ends of the tubular member at block 156. For instance, referring to FIG. 7, the axial ends 200*a*, 200*b* of the tubular member 200 may be upset such that the upper upset 54 and the lower upset 56 are formed thereon. As previously described, the upper upset 54 and the lower upset 56 may include both an outer upset 54*a*, 56*a*, respectively, on the radially outer surface 50*c* and an inner upset 54*b*, 56*b*, respectively, on the radially inner surface 50*d*. In some embodiments, the axial ends 200*a*, 200*b* of the tubular member 200 are upset by axially (along axis 55) impacting the axial ends 200*a*, 200*b* with a suitable ram, hammer, or other suitable implement such that the material of the tubular member 200 is moved to form the upper upset 54 and the lower upset 56. As previously described, the axial ends 200*a*, 200*b* may be heated before impacting the axial ends 200*a*, 200*b* to form the upsets 54, 56, respectively.

In some embodiments, block 156 may be performed after blocks 152 and 154 so that the axial ends of the tubular member are upset after the one or more wear pads are formed on the radially outer surface. Conversely, in some embodiments, block 156 may be performed before blocks 152 and 154 so that the axial ends of the tubular member are upset before the one or more wear pads are formed on the radially outer surface.

Referring again to FIG. 4, method 150 includes attaching threaded connectors to the upset axial ends of the tubular member at block 158. For instance, referring now to FIG. 8, the threaded connectors 80, 60 are attached to the upset axial ends 200*a*, 200*b* via welding. Attaching the threaded connectors 80, 60 to the axial ends 200*a*, 200*b* may complete the drill pipe 50 as described above. Thus, the wear pad(s) 100 is (are) positioned along the tubular portion 58 of as previously described.

Figure 9:
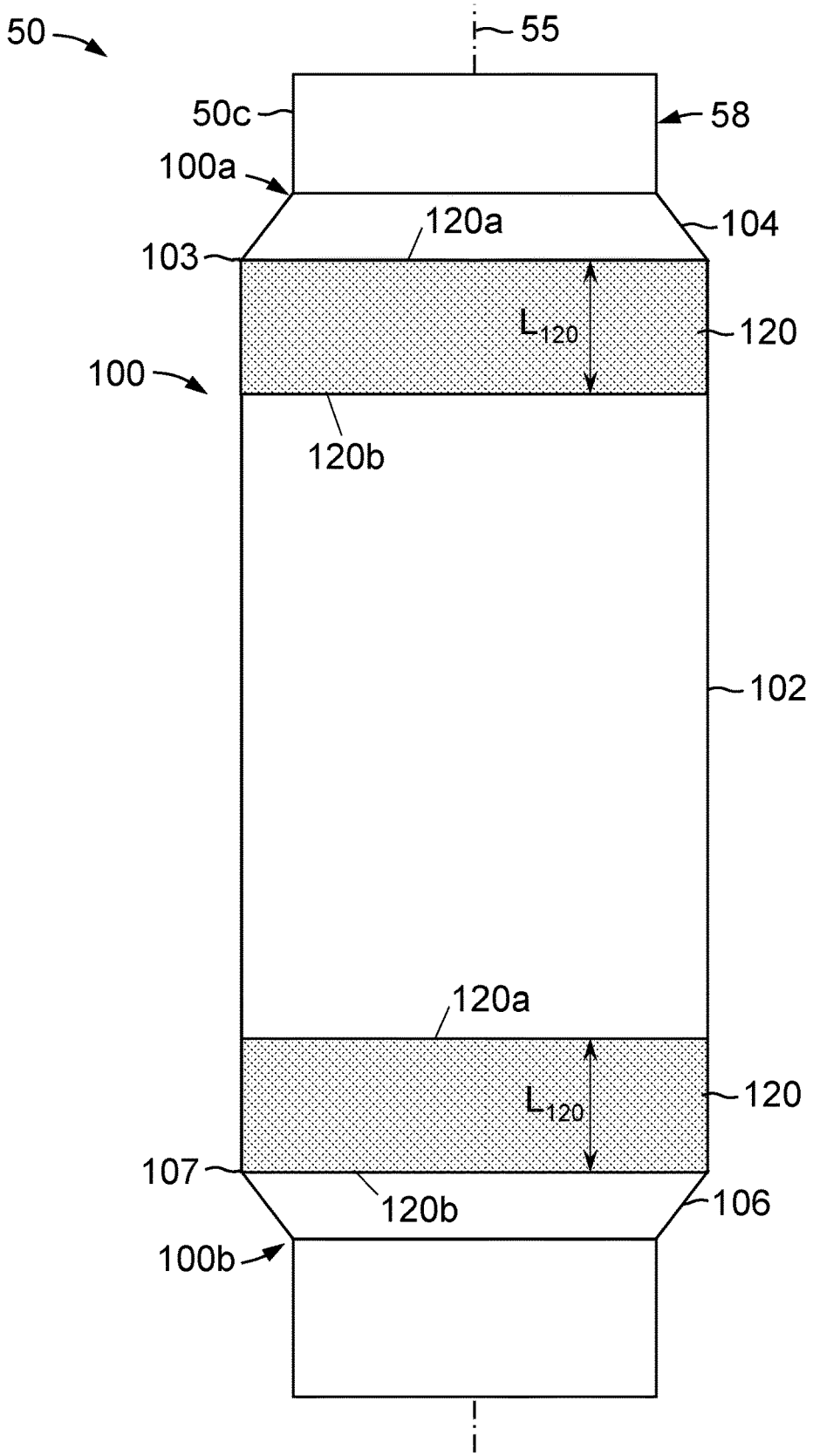
FIG. 9 is a side view of a wear pad that may be included on the drill pipe of FIG. 2 according to some embodiments.

Referring now to FIG. 9, in some embodiments, the cylindrical surface 102 (or a portion thereof) along one or more of the wear pads 100 may include one or more annular abrasion resistant treatments 120 to enhance the wear resistance and durability of the corresponding wear pads 100. In general, the annular abrasion resistant treatment 120 can be provided at one or more discrete locations along the cylindrical surface 102 or provided along the entire cylindrical surface 102 (i.e., extend axially from radius 103 to radius 107). In the embodiment shown in FIG. 9, two annular abrasion resistant treatments 120 are provided on the cylindrical surface 102. Each annular abrasion resistant treatment 120 extends annularly about the entire circumference of the cylindrical surface 102. In this embodiment, one annular abrasion resistant treatment 120 extends axially from each radius 103, 107. In addition, each annular abrasion resistant treatment 120 includes a first or uphole end 120*a*, a second or downhole end 120*b*, and a length $L_{120}$ measured axially from end 120*a* to end 120*b*. In general, the length $L_{120}$ of each abrasion resistant treatment 120 can vary, be different as one or more other abrasion resistant treatments 120, be the same as one or more other abrasion resistant treatments 120, or combinations thereof as desired and depending on the particular application. For example, in some embodiments, the length $L_{120}$ of each abrasion resistant treatment 120 can range from ¾ in. to 2.0 in. In embodiments where a single abrasion resistant treatment 120 covers the entire cylindrical surface 102, the length $L_{120}$ of the abrasion resistant treatment 120 is the same as the axial length of the cylindrical surface 102 (measured axially from radius 103 to radius 107).

In general, each abrasion resistant treatment 120 can be any coating, layer, or treatment known in the art that hardens and enhances the abrasion resistance of one or more regions of the cylindrical surface 102. Examples of suitable treatments that can be used for any one or more abrasion resistant treatments 120 include, without limitation, a hard coating or hard banding comprising a material that is harder than the underlying material defining the cylindrical surface 102 (e.g., TCS-Titanium, TCS-800, TCS-XL, or Smooth-X available from Tubuscope of National Oilvwell Varco, Inc. of Houston, Texas, USA; or other hardmetal wear protection applied by various methods such as welding, cladding, or the like); or a surface hardening to enhance the hardness of the material defining the cylindrical surface 102 (e.g., heat treating, thermal hardening, induction or flame hardening, shot or laser peening, nitriding, cold rolling, or the like). In embodiments employing hard banding for the abrasion resistant treatment 120, the hard banding can be disposed in an elevated or raised annular recess formed in the cylindrical surface 102 such as employed in SmoothEdge® technology available from Grant Prideco, Inc. of Houston, Texas USA.

Figure 10:
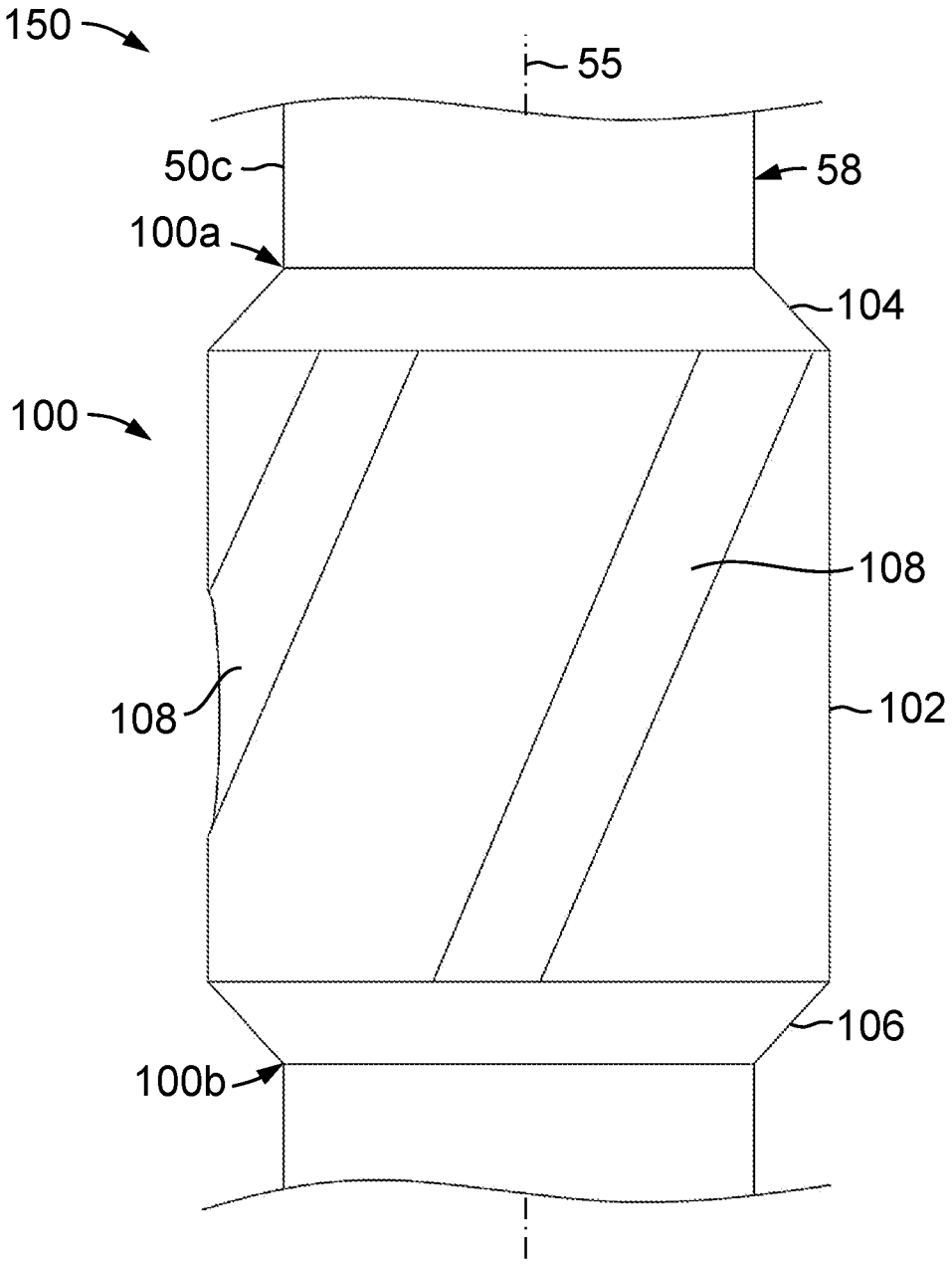
FIG. 10 is a side view of a wear pad that may be included on the drill pipe of FIG. 2 according to some embodiments.

Referring now to FIG. 10, in some embodiments the wear pads 100 of the drill pipe 50 may include one or more grooves 108 that extend radially into the cylindrical surface 102. For instance, the one or more grooves 108 may extend helically about the central axis 55 between the transitional surfaces 104, 106. During operations, the grooves 108 may form flow channels that allow fluid (e.g., drilling fluid) to flow axially past the wear pads 100. Thus, the inclusion of the grooves 108 may prevent the wear pads 100 from becoming fluid flow obstructions within the borehole during drilling operations.

The embodiments disclosed herein include tubular members and methods for producing tubular members, which have a greater service life and durability than standard tubular members. In particular, as previously described, the disclosed embodiments may include tubular members for drill string which have one or more wear pads that are to increase fatigue resistance, wear resistance and damage tolerance for the tubular members during drilling operations.

The discussion above is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function.

The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the discussion herein and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and when stated in relation to the given value mean within a range of plus or minus 10% of the given value. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees and should be interpreted to include only commercially practical values.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tubular member, comprising:

a central axis, a first end, a second end opposite the first end, a radially outer surface extending axially from the first end to the second end, and a radially inner surface extending axially from the first end to the second end, wherein the radially inner surface defines a throughbore extending axially from the first end to the second end;

a first connector at the first end;

a second connector at the second end;

a tubular region axially positioned between and axially spaced from the first connector and the second connector;

a first upset extending axially from the first connector to the tubular region, wherein the first upset has an internal transition within the throughbore that increases an inner diameter of the throughbore when moving axially from the first upset to the tubular region, and wherein the first upset has an external transition on the radially outer surface that decreases an outer diameter of the tubular member when moving axially from the first upset to the tubular region; and a first wear pad integrally formed on the tubular region, wherein an outer diameter of the tubular member is greater along the first wear pad than along the tubular region.

2. The tubular member of claim 1, further comprising a second wear pad integrally formed on the tubular region and axially spaced from the first wear pad, wherein the outer diameter of the tubular member is greater along the second wear pad than along the tubular region.

3. The tubular member of claim 2, wherein a maximum outer diameter of the first wear pad is different from a maximum outer diameter of the second wear pad or an axial length of the first wear pad is different from an axial length of the second wear pad.

4. The tubular member of claim 1, wherein the first wear pad includes a helical groove extending radially into the first wear pad.

5. The tubular member of claim 1, wherein the first wear pad has a radially outer cylindrical surface including an abrasion resistant treatment.

6. The tubular member of claim 5, wherein the abrasion resistant treatment comprises a hard coating or hard banding.

7. The tubular member of claim 1, wherein the first wear pad comprises:

a first end;

a second end axially spaced from the first end of the first wear pad;

a radially outer cylindrical surface axially positioned between the first end of the first wear pad and the second end of the first wear pad;

a first transitional surface extending axially from the first end of the first wear pad to the cylindrical surface; and a second transitional surface extending axially from the cylindrical surface to the second end of the first wear pad.

8. The tubular member of claim 7, wherein the first transitional surface and the second transitional surface are frustoconical surfaces.

9. The tubular member of claim 8, wherein a length of the first transitional surface is in a range from about 6.25% to about 12.5% of an axial length between the first end of the first wear pad and the second end of the first wear pad.

10. The tubular member of claim 1, wherein a wall thickness of the tubular member along the wear pad is from about 1.3 to about 2 times greater than a wall thickness of the tubular member along the tubular region.

11. A method of manufacturing a tubular member, the method comprising:

(a) removing material from a radially outer surface of a cylindrical tubular member, wherein the cylindrical tubular member has a central axis;

(b) forming a wear pad on the radially outer surface of the tubular member as a result of (a);

(c) upsetting an axial end of the tubular member to form an upset that extends axially from the axial end of the tubular member, wherein the upset has an internal transition distal the axial end and an external transition distal the axial end, wherein the internal transition increases an inner diameter of the cylindrical tubular member when moving axially along the upset away from the axial end and the external transition decreases an outer diameter of the cylindrical tubular member when moving axially along the upset away from the axial end; and (d) attaching a connector to the upset at the axial end of the tubular member.

12. The method of claim 11, further comprising performing (b) before performing (c).

13. The method of claim 11, further comprising performing (c) before performing (b).

14. The method of claim 11, wherein (a) comprises engaging a tool with the radially outer surface to remove the material.

15. The method of claim 11, wherein the wear pad comprises:

a first end;

a second end axially spaced from the first end of the first wear pad;

a cylindrical surface axially spaced between the first end and the second end;

a first transitional surface extending axially from the first end to the cylindrical surface; and a second transitional surface extending axially from the cylindrical surface to the second end.

16. The method of claim 15, wherein the first transitional surface and the second transitional surface are frustoconical surfaces.

17. The method of claim 16, wherein a length of the first transitional surface is in a range from about 6.25% to about 12.5% of an axial length between the first end and the second end.

18. The method of claim 16, wherein a wall thickness of the tubular member along the wear pad is from about 1.3 to about 2 times greater than a wall thickness of the tubular member along the tubular region.

19. A drill pipe, comprising:

a central axis;

a box connector;

a pin connector axially spaced from the threaded box connector;

a tubular region axially positioned between and axially spaced from the box connector and the pin connector;

a first upset extending axially from the box connector to the tubular region;

a second upset extending axially from the pin connector to the tubular region;

a throughbore extending axially through the box connector, the first upset, the tubular region, the second upset, and the pin connector, wherein an inner diameter of the throughbore increases moving axially from the first upset into the tubular region and moving axially from the second upset into the tubular region, and wherein an outer diameter of a radially outer surface of the drill pipe decreases moving axially from the first upset into the tubular region and moving axially from the second upset into the tubular region;

a wear pad formed on the tubular region, wherein an outer diameter of the drill pipe is greater along the wear pad than along the tubular region.

20. The drill pipe of claim 19, wherein the wear pad comprises:

a first end;

a second end axially spaced from the first end;

a cylindrical surface axially spaced between the first end and the second end;

a first transitional surface extending axially from the first end to the cylindrical surface; and a second transitional surface extending axially from the cylindrical surface to the second end.

21. The drill pipe of claim 20, wherein a length of the first transitional surface is in a range from about 6.25% to about 12.5% of an axial length between the first end and the second end.

* * * * *